United States Patent [19]

Griswold

[11] 4,136,418

[45] Jan. 30, 1979

[54] SNOW REMOVAL DEVICE

[76] Inventor: James M. Griswold, 181 Raymond St., Pontiac, Mich. 48058

[21] Appl. No.: 818,209

[22] Filed: Jul. 22, 1977

[51] Int. Cl.[2] ..... A46B 5/02; A46B 17/08

[52] U.S. Cl. ..... 15/111; 15/143 R

[58] Field of Search ..... 15/106, 111, 113, 114, 15/117, 143 R, 159 R, 160; 401/6; D4/6, 13

[56] References Cited

U.S. PATENT DOCUMENTS

| | | | |
|---|---|---|---|
| D. 101,017 | 8/1936 | Waters | 15/159 R UX |
| D. 199,177 | 9/1964 | Kennedy | D4/6 |
| D. 232,299 | 8/1974 | Epstein | D4/6 X |
| 630,844 | 8/1899 | Barratt | 15/160 |
| 2,792,584 | 5/1957 | Fryda | 15/111 X |
| 4,041,564 | 8/1977 | Schlicher | 15/111 |

FOREIGN PATENT DOCUMENTS

| | | | |
|---|---|---|---|
| 1925013 | 11/1970 | Fed. Rep. of Germany | 15/111 |
| 10422 of | 1844 | United Kingdom | 15/111 |
| 5667 of | 1895 | United Kingdom | 15/160 |
| 265359 | 2/1927 | United Kingdom | 15/160 |
| 562430 | 6/1944 | United Kingdom | 15/143 R |

*Primary Examiner*—Daniel Blum

*Attorney, Agent, or Firm*—Harness, Dickey & Pierce

[57] ABSTRACT

A snow removal device particularly adapted for use in quickly clearing heavy accumulations of snow from various portions of a vehicle such as windows, engine hoods, roofs and trunk lids and the like. The snow removal device comprises a housing having an integrally formed handle portion from which an extremely large number of relatively long stiff bristles extend. The housing is also provided with a scraper blade which may be either integrally formed therewith or separately manufactured and secured within a recess formed in the housing.

2 Claims, 3 Drawing Figures

SNOW REMOVAL DEVICE

BACKGROUND AND SUMMARY OF THE INVENTION

The present invention relates generally to snow removal devices and more particularly to such snow removal devices which are adapted for clearing heavy accumulations of snow and/or ice from various portions of a vehicle.

Various types of snow removal brushes are presently available on the market in numerous shapes and sizes. Typical of these snow removal devices is one comprising an elongated cylindrically shaped member generally of wood and having one or two longitudinally extending rows of bristles extending generally radially outward from one side thereof and may include a scraper blade or the like secured to the opposite end. While these snow brushes do a reasonable job in removing light accumulations of snow from the various surfaces of a vehicle, they are not well suited for heavy accumulations such as are often encountered in the snow belt regions of the country due primarily to the fact that only a few bristles are provided thereon as well as the high degree of flexibility thereof. In order to clear such heavy accumulations, an individual using the presently available snow brushes must make numerous passes with the device removing only at best an inch or two of snow each time. As a result, many individuals will clear only a very small portion of the vehicle sufficient to afford only marginal visibility. Thus, the vehicle operator's vision may be restricted to view only what lies directly in front of the vehicle and even this limited visibility may be obstructed by blowing snow from the uncleared engine hood. Further, the uncleared snow accumulated on these other portions of the vehicle may create a further hazard as the visibility of the vehicle to other drivers may be substantially reduced. Also, as the bristles on such brushes are relatively short and also fairly flexible, it may be difficult or even impossible to clear the snow from around the exterior lights of the vehicle particularly in certain vehicles having recessed lighting surrounded by trim or body panels.

Another type snow brush of which applicant is aware is similar to a small push broom having a bristle containing head with a handle extending outward therefrom generally perpendicular to and centrally disposed with respect to the longitudinal axis of the head. While this type of snow brush may be more effective for removal of heavy snow accumulations than the brush previously mentioned, it is difficult to use in that it requires a push and pull motion by the individual which results in the user pulling accumulations of snow from the vehicle toward himself. Thus, the individual must be able to step back from the vehicle in order to avoid being covered by the snow being removed from the vehicle. This may not always be possible due to adjacent vehicles or other obstructions along either or both sides of the vehicle.

Accordingly, the present invention provides an improved snow removal device which overcomes the above mentioned disadvantages and is particularly suited for removal of heavy snow accumulations from various portions of a vehicle. The present invention includes a housing having a large number of relatively long stiff bristles which enable the brush to clear large quantities of snow with a single pass and includes an integrally formed hand grip which enables an individual to use the device with any desired direction of movement and affords a comfortable engagement with the hand allowing full control of the movement thereof. Also, the large number of long stiff bristles enable the user to easily gain access to substantially all recessed lighting configurations thereby enabling him to easily clear snow accumulations from these areas. This is very important to safe vehicle operation in that other drivers will more readily be able to ascertain the presence of and current operational status of the vehicle (i.e. braking, turning, etc.). Further, as the present invention is capable of removing greater quantities of snow with each pass, individuals will be more inclined to fully clear the vehicle thereby improving both the operator's ability to see and be seen and aiding in ensuring maximum safety in vehicle operation. The present invention may also be provided with a separate or integrally formed blade member for use in dislodging ice accumulations which may also occur on the vehicle.

Additional advantages and features will become apparent from the following description of the preferred embodiments taken in conjunction with the attached drawings and claims appended hereto.

DESCRIPTION OF THE PREFERRED EMBODIMENTS

Figure 1:
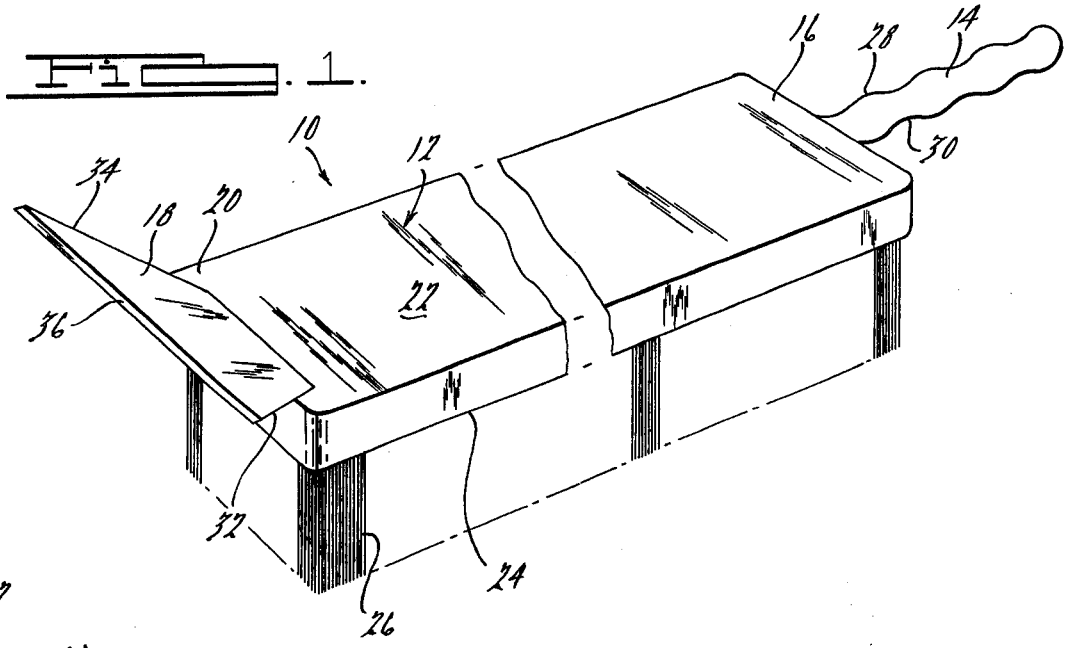
FIG. 1 is a perspective view of a snow removal device in accordance with the present invention.

Referring now to FIG. 1, there is shown a snow brush in accordance with the present invention indicated generally at 10. Snow brush 10 comprises a housing 12 of a generally rectangular shape of substantial width having an integrally formed handle portion 14 provided thereon adjacent one end 16 thereof and a blade portion 18 provided at the opposite end 20 and inclined upwardly and outwardly from surface 22 and, as shown in the drawings, beyond the longitudinal end portion of housing 12. Lower surface 24 of housing 12 has a plurality of relatively long bristles 26 extending outwardly in a generally perpendicular relationship thereto. Preferably bristles 26 will be densely arranged and will cover substantially the entire lower surface 24. As shown in FIG. 1, preferably handle portion 14 of snow brush 10 will be integrally formed with housing 12 and of a generally cylindrical shape having a length suitable to provide a secure hand grip and including a plurality of circumferential undulations forming rounded peaks 28 and valleys 30 along the length thereof which are adapted to provide a comfortable engagement with the hand of a user of the snow brush.

Blade portion 18 also may be integrally formed with housing portion 12 of snow brush 10 and is inclined upwardly and outwardly therefrom having lateral edges 32 and 34 which diverge in an outward direction from housing 12. The outer edge 36 of blade portion 18 is provided with a beveled surface which surface lies in a plane substantially parallel to the plane defined by surface 22 of housing 12. This beveled surface is adapted to engage the window surface portions of a motor vehicle so as to allow the user to scrape accumulations of ice or frost therefrom.

As previously mentioned, housing portion 12 along with handle portion 14 and blade 18 will preferably all be integrally formed from any suitable material such as a plastic composition by any suitable process such as injection molding thus affording a relatively inexpensive means for fabricating an entire snow brush device having a scraper blade provided thereon. Further, the housing 12 may be provided with openings in the bottom thereof into which bristles 26 may be subsequently installed in any suitable manner such as by use of a suitable adhesive material. Alternatively it may be possible to embed bristles 26 within housing 12 simultaneously with the molding thereof. It also should be noted that bristles 26 will preferably be of a relatively long length relative to the size of housing 12 and will be relatively stiff so as to insure complete removal of large accumulations of snow with a single pass of snow brush 10. Further, as snow brush 10 will generally be used by moving it in a direction generally perpendicular to the longitudinal axis thereof, the substantial width of housing 12 is provided with a large number of bristles in the transverse direction so as to insure a clean sweep with a single pass of even very substantial accumulations of snow from the various portions of a vehicle. Further, it should be noted that the longitudinal length of snow brush 10 will be suitable so that a relatively large area may be cleared with a single pass thereby insuring that individuals using such a snow brush will fully and adequately clean all of the critical portions of a vehicle prior to operation thereof.

Figure 2:
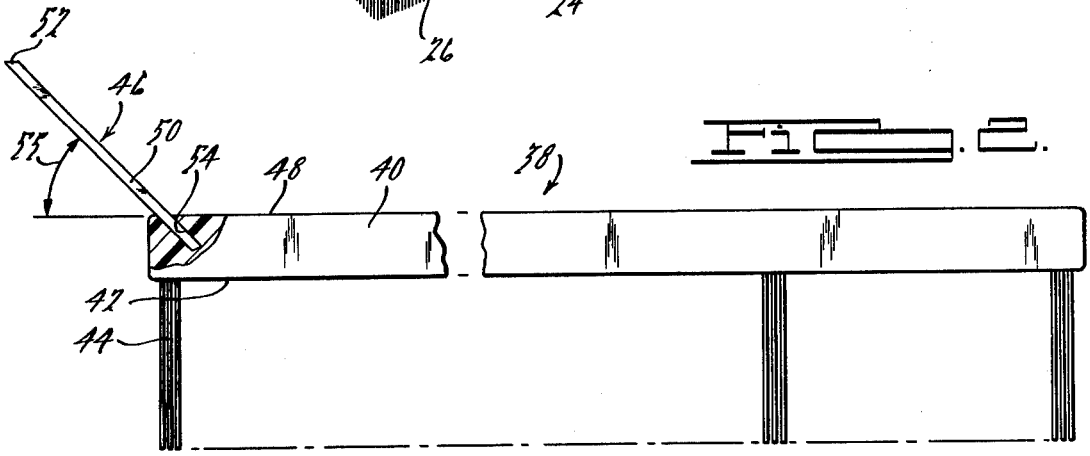
FIG. 2 is an elevational view of another embodiment of the snow removal device in accordance with the present invention having a portion thereof broken away.

Referring now to FIG. 2, there is shown another embodiment of a snow brush in accordance with the present invention indicated at 38. Snow brush 38 is similar to snow brush 10 having a housing 40 also of substantial width which includes a lower surface 42 from which a large number of relatively stiff, long bristles 44 project in a generally perpendicular downward direction. However, in this embodiment no separate handle portion is provided on housing 40 but rather the bristles are provided along the entire lower surface 42 thereof for the full longitudinal length of housing 40 thus providing a snow brush capable of sweeping a maximum surface without unnecessarily increasing its overall length which may hamper storage thereof in the vehicle. Also, snow brush 38 is provided with a blade member 46 having a shape substantially the same as blade portion 18 including diverging lateral edges 50 and beveled end portion 52. However, in this embodiment blade member 46 is not integrally formed with housing 40 but rather is secured within an inclined inwardly extending opening 54 formed in housing 40. Preferably, blade portion 40 will be upwardly inclined relative to the upper surface 48 of housing 40 at an angle 55 of approximately 45° thereby allowing convenient engagement of beveled surface 52 with the surface to be scraped. Blade portion 40 may be secured within slot 54 in any suitable manner such as for example by a suitable adhesive and may be fabricated of any suitable material such as a plastic composition or hard-like material for example.

Figure 3:
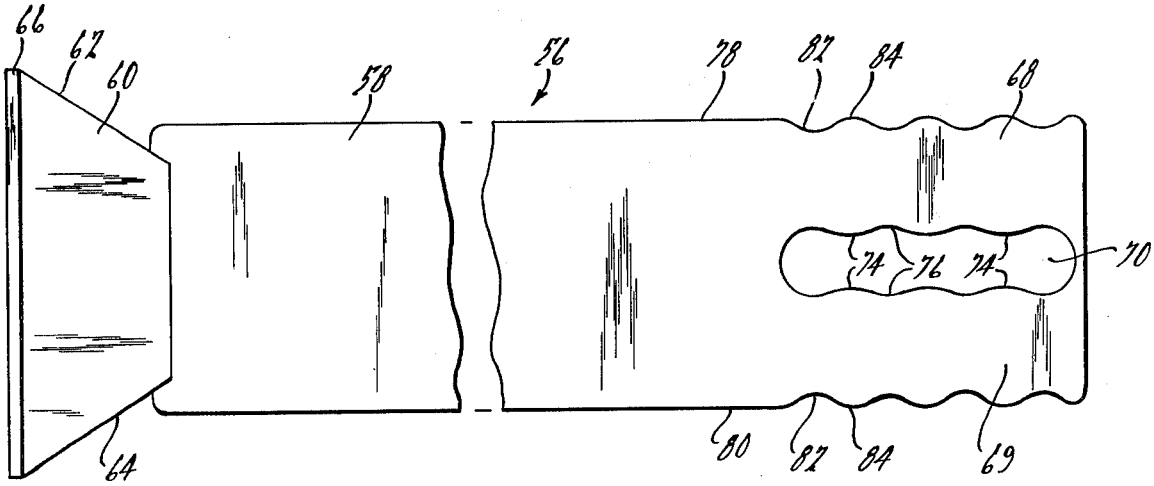
FIG. 3 is a plan view of yet another embodiment of the present invention.

Yet another embodiment of the present invention is shown at 56 in FIG. 3 and comprises a generally rectangularly shaped elongated housing portion 58 of substantial width having a scraper blade member 60 extending outwardly therefrom in an inclined manner similar to that described with reference to blade member 48 and blade portion 18 described above. Blade member 60 is substantially indentical to blade member 48 and 18 described above including diverging lateral edges 62 and 64 and a beveled outer edge portion 66. The lower surface of housing portion 58 will similarly be provided with a large number of relatively long stiff bristles substantially identical to those described above with reference to FIGS. 1 and 2 along the entire lower surface thereof. In this embodiment, however, a handle portion is provided at one end 68 of housing 58 and comprises a longitudinally extending slot 70 extending through housing 58 which is provided with a plurality of undulations forming inwardly projecting rounded peaks 74 on opposite sides thereof with valley portions 76 interposed therebetween. Each of the lateral side portions 78 and 80 are also provided with similar undulations forming rounded peaks 82 and valleys 84 therealong which correspond to the peaks and valleys provided within elongated opening 70. Thus, the undulations provided in opening 70 as well as either of the respective undulations provided along the lateral surfaces 78 and 80 cooperate to provide a convenient hand grip for an individual employing the brush and further are adapted to easily allow the brush to be gripped in either the right or left hand of the individual with the snow brush extending outward from the inside or thumb side of the individual's hand thereby allowing convenient comfortable use in either hand such as for sweeping from alternate sides of a vehicle. It should also be noted that should it be desirable the lower surface of housing 56 lying between lateral edges 78 and 80 and opening 70 may be provided with bristles so as to allow even this portion to provide a wiping action as the brush is used in removing snow from various portions of the vehicle.

Thus, as is apparent from the above description of the preferred embodiments, the present invention provides an improved snow brush particularly adapted for removing snow and ice accumulations from various portions of a vehicle and because of its relatively large number of transversely extending relatively long stiff bristles, the brush of the present invention will enable an individual to remove substantially greater amounts of snow with a single pass than can be accomplished with presently available snow brushes. This has the advantage of increasing the likelihood that the individual will take the time to insure that he has performed an adequate job of removing the snow from both front and rear windshields as well as various other portions of the vehicle even should he be in an extreme hurry. Further, the relatively long length of the bristles will easily enable an individual to clear the snow from around various lights provided on the car such as the headlights and/or taillights and turn signals provided thereon thus further insuring the operation safety of the motor vehicle.

While it will be apparent that the preferred embodiments of the invention disclosed are well calculated to provide the advantages above stated, it will be appreciated that the invention is susceptible to modification, variation and change without departing from the proper scope or fair meaning of the subjoined claims.

I claim:

1. A snow removal device comprising an elongated generally rectangular housing having a substantially transverse width; a plurality of bristles covering substantially an entire lower surface of said housing and projecting outwardly therefrom, said bristles being of a generous length; and said housing having an integral hand grip adjacent one end provided thereon adapted to provide a comfortable engagement with the hand of an individual; and a scraper blade associated therewith, said scraper blade extending outward from another surface of said housing individual; said hand grip including an elongated slot in said housing adjacent one end so as to define a first portion adapted to allow the right hand of an individual to grasp said snow removal device with said snow removal device extending outwardly from the thumb side of said right hand and a second portion adapted to allow the left hand of an individual to grasp said snow removal device with said snow removal device extending outwardly from the thumb side of said left hand; said slot being defined by undulating sidewalls in said housing and said housing further being provided with corresponding undulations along a portion of each of the lateral sidewalls of said housing, said portions being opposite and coextensive with said elongated slot.

2. A snow removal device as set forth in claim 1 wherein said bristles also extend outward from the lower surface of said integrally formed hand grip.

* * * * *